US006831829B2

(12) United States Patent
Einhorn et al.

(10) Patent No.: US 6,831,829 B2
(45) Date of Patent: Dec. 14, 2004

(54) FURNITURE WITH VERTICALLY MOVABLE FLAT PANEL DISPLAY SCREEN

(75) Inventors: Shimon Einhorn, Passaic, NJ (US); Shamir Einhorn, Passaic, NJ (US); David Einhorn, Passaic, NJ (US)

(73) Assignee: Sharut Furniture, Passaic, NJ (US)

( * ) Notice: Subject to any disclaimer, the term of this patent is extended or adjusted under 35 U.S.C. 154(b) by 113 days.

(21) Appl. No.: 10/269,145

(22) Filed: Oct. 11, 2002

(65) Prior Publication Data

US 2004/0075970 A1 Apr. 22, 2004

(51) Int. Cl.[7] ..... G06F 1/16
(52) U.S. Cl. ..... 361/681; 361/724
(58) Field of Search ..... 361/681, 682, 361/724–727

(56) References Cited

U.S. PATENT DOCUMENTS 5,857,415 A * 1/1999 Richard ..... 108/50.01
6,550,724 B2 * 4/2003 Gosling ..... 248/125.2
6,580,602 B2 * 6/2003 Zodnik ..... 361/683

OTHER PUBLICATIONS

Breckner et al. (US 2003/0064801 A1), "Decoupling of the Graphicalpresentation of a Game from the Presentation Logic", Apr. 3, 2003.*

Pleiman et al. (US 2003/0173877 A1), "Corner Storage Container", Sep. 18, 2003.*

* cited by examiner

*Primary Examiner*—Yean-Hsi Chang
(74) *Attorney, Agent, or Firm*—Cohen, Pontani, Lieberman & Pavane

(57) ABSTRACT

A furniture assembly includes a base, a pair of lifting columns flanking the base, a mounting panel fixed to the lifting columns in front of the base so that it can be raised and lowered, and a flat electronic display screen fixed to the mounting panel. According to a preferred embodiment, the furniture assembly is a modular assembly and includes a top module detachably fixed to a base module. The mounting panel can be moved between an upper position, where it at least partially covers the top module, and a lower position, where it at least partially covers the base module. The assembly includes a wiring harness fixed to the back of the screen for inputting video signals to the display screen from a number of electronic sources such as a TV antenna, a VCR, a DVD player, and a computer. The harness is movable through a space between the front and the rear of the base under the action of a retracting mechanism which keeps the harness taut as the panel is raised and lowered.

22 Claims, 7 Drawing Sheets

FURNITURE WITH VERTICALLY MOVABLE FLAT PANEL DISPLAY SCREEN

BACKGROUND OF THE INVENTION

1. Field of the Invention

The invention relates to furniture, in particular a modular furniture assembly having a vertically movable mounting panel carrying a display screen.

2. Description of the Related Art

Furniture designed to house home entertainment systems typically has cabinets and shelves for a television, stereo system, VCR and other components, as well as space for storing records, CDs, and cassettes, and further providing space for displaying bric-a-brac, photographs, etc. Likewise, computer work stations have cabinets and shelves for a computer, a computer monitor, peripherals, and work-related items. What these systems have in common is the requirement of a space to accommodate a display screen which typically functions as a television (TV) and/or a computer monitor. A shortcoming of this arrangement is that the display screen takes up a fixed amount of space in the furniture, which space can serve no other purpose.

In recent years, display screens have been developed by a number of manufacturers that are flat and relatively thin in comparison to CRT's (cathode ray tubes). These are becoming increasingly more economical to own. The technology applied in these screens is LCD (liquid crystal display) or plasma. These screens utilize the same electronic signal information as a conventional CRT. One of the chief advantages of such screens is that they do not require any substantial depth, and may thus be designed as a relatively flat package which can be hung on a wall. Another advantage is that they are available in large sizes, e.g. even in widths exceeding 50 in., and permit viewing from a considerable distance.

It would be desirable to incorporate a flat screen into a piece of furniture such as a home entertainment system or workstation. However, fixing the screen into a position within the furniture piece would render the space it occupies, and also the space in front of it, unusable for anything else. Likewise, if the screen were mounted toward the front of the furniture piece, this would render the space behind it inaccessible. Thus, a considerable amount of space would be rendered unusable, particularly where a large size screen is desired. This is a significant disadvantage, particularly where space is at a premium, such as in an urban apartment. Mounting such a screen elsewhere, i.e. outside the furniture piece, would not only separate it from other components of the entertainment system or workspace and require connection with unsightly wiring, but would take up wall space which could be used otherwise.

SUMMARY OF THE INVENTION

One object of the invention is to provide multi-purpose furniture arranged to mount a flat display screen so as to occupy no more than minimal space therein.

Another object of the invention is to provide multi-purpose furniture arranged to mount a flat display screen so as to not impede access to space therein.

A further object of the invention is to provide a furniture-mounted display screen arranged so it can be conveniently and safely wired to receive signals from any one of multiple sources located conveniently to the screen.

Yet another object of the invention is to enable mounting a flat display screen in a corner of a room.

Still another object of the invention is to provide a flat display screen mounted so as to be vertically adjustable on a piece of furniture.

An additional object of the invention is to provide an electrically powered, vertically adjustable mounting for a flat display screen on a piece of furniture arranged so that the powered motion is controlled so as to avoid injury to users.

One other object of the invention is to provide an electrically powered, vertically adjustable mounting for a flat display screen on a piece of furniture arranged so that exposure of the screen to damage during an off mode is minimized.

These and other objects are attained in accordance with one aspect of the invention which provides a base having a front, a rear, and a pair of opposed sides; a pair of lifting mechanisms arranged adjacent to respective sides, with each lifting mechanism being capable of vertically raising and lowering an article fixed thereto. A mounting panel arranged adjacent to the front of the base and fixed to the lifting mechanisms is provided so that the mounting panel can be vertically raised and lowered by the lifting mechanisms. A flat electronic display screen fixed to the mounting panel is also provided and at least one wire coupled to the display screen is provided for inputting electronic video signals. The lifting mechanisms are preferably in the form of columns having respective vertically movable blocks to which the mounting panel is fixed. In a preferred embodiment, the blocks are driven to move synchronously by respective electric motors, which may be activated by remote control.

In accordance with another aspect of the invention, an assembly for mounting a flat electronic display screen in a corner of a room is provided. The assembly includes a base having a substantially right triangular profile, the base having a front, a rear for fitting in the corner, and a pair of opposed sides. A mounting panel is secured at the front of the base and positioned between the sides, and a flat electronic display screen is provided which is fixed to the mounting panel.

In accordance with a still further aspect of the invention, a workstation is provided, which includes a base having a front, a rear, and a pair of opposed sides, with a flat electronic display screen fixed to the front of the base, and a CRT disposed in the base.

In accordance with yet another aspect of the invention, an apparatus for positioning a flat electronic display screen is provided. The apparatus includes a furniture piece having a front facing into a room, and a rear. A moving means is provided powered by drive means for moving the flat electronic display screen vertically in a plane adjacent to the front of the furniture piece. The apparatus also includes drive control means for actuating the powered drive means to move the flat electronic display screen to a desired position in the plane, and a sensor for detecting when the flat electronic display screen is turned OFF to generate an output signal, wherein the drive control means responds to the output signal when the screen is turned OFF to move the screen to a predetermined position.

The furniture may be realized as a combination of modules which are fixed together to form a modular furniture assembly having the columns incorporated therein. For example, the lifting columns may be placed on either side of a base module or combination of modules in front of which the mounting panel carrying the screen can be moved. End modules provided on either side of the columns can be used to brace the columns. The invention may also be employed in a corner piece having no end pieces, such as a hutch, wherein the lifting columns flank a central module or modules which are profiled to fit in a corner.

The modular furniture system may be configured as a home entertainment center, as a computer work station, or as a combination of the two. It is thus especially well suited to a highly integrated environment such as an urban apartment or other multi-functional space such as a combination of an office, library, and audio-visual center. It may also be used in a conference room setting for receiving a signal from an electronic writing tablet so that a person's notes can be used to generate an image which is visible to everyone in the room.

It is to be noted that the term furniture, as used herein, is not limited to readily movable pieces in a room, but encompasses desks, bookcases, and fixtures which may not be readily movable and may even be permanently installed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
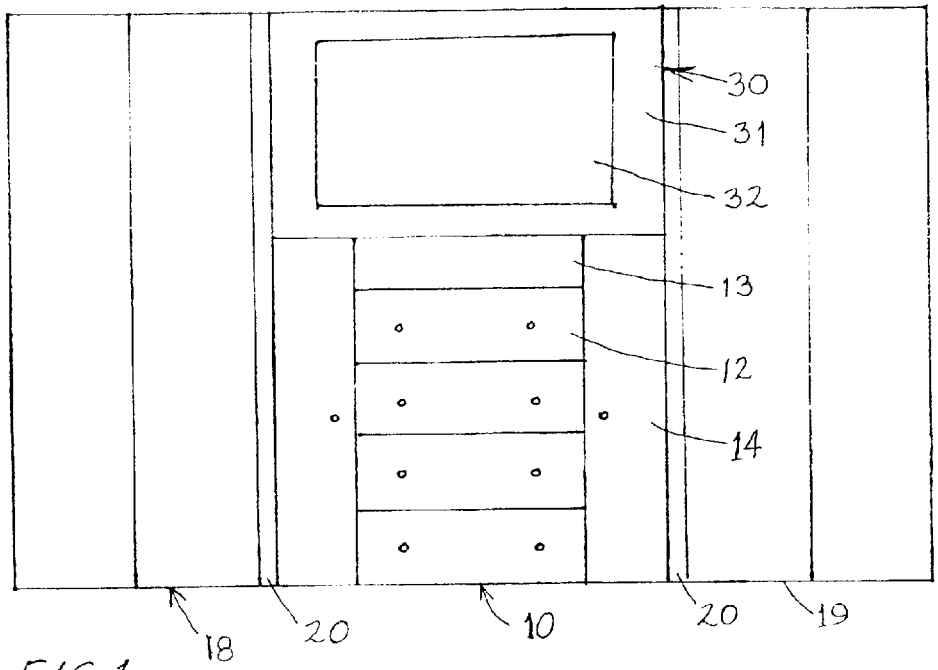
FIG. 1 is a front elevation view of a first embodiment of a modular furniture assembly according to the present invention.

FIG. 1 shows a first embodiment of a modular furniture assembly according to the present invention, which includes a base module 10 and left and right modules 18, 19. A pair of lifting columns 20 flanks the base module 10, and a mounting panel 30 is mounted to and between the lifting columns 20 to enable vertical movement thereof. The left and right modules 18, 19 flank respective columns 20. The base module 10, as shown, includes drawers 12, an appliance space 13 for a VCR, DVD, a stereo receiver and the like above the drawers, and cabinets 14 flanking the drawers. The module 10 may have any desired arrangement of shelves, drawers and cabinets. Likewise the left and right modules 18, 19 may have any desired arrangement of shelves, drawers and cabinets for books, records, speakers, appliances, or anything else.

The mounting panel 30 has a front surface 31 which carries a flat screen 32, commonly referred to as a flat panel TV. Such a screen utilizes the same signals as a CRT to generate an image and accordingly may be used as a TV screen or a computer monitor. When it is used as a TV screen the signals can be provided by an antenna, satellite receiver and/or cable, a VCR, or a DVD player. When it is used as a computer monitor, the signals can be provided from the internet, a CD, or a floppy disk. The mounting panel 30 is shown in its raised position where it conceals an upper module 17 (FIGS. 2, 6A, 6C) which is mounted over the base module 10. When lowered, the mounting panel 30 will cover at least a portion of the base module 10 and provide access to the upper module. The screen may be active, i.e. turned ON, in any vertical position along its range of travel.

Figure 2:
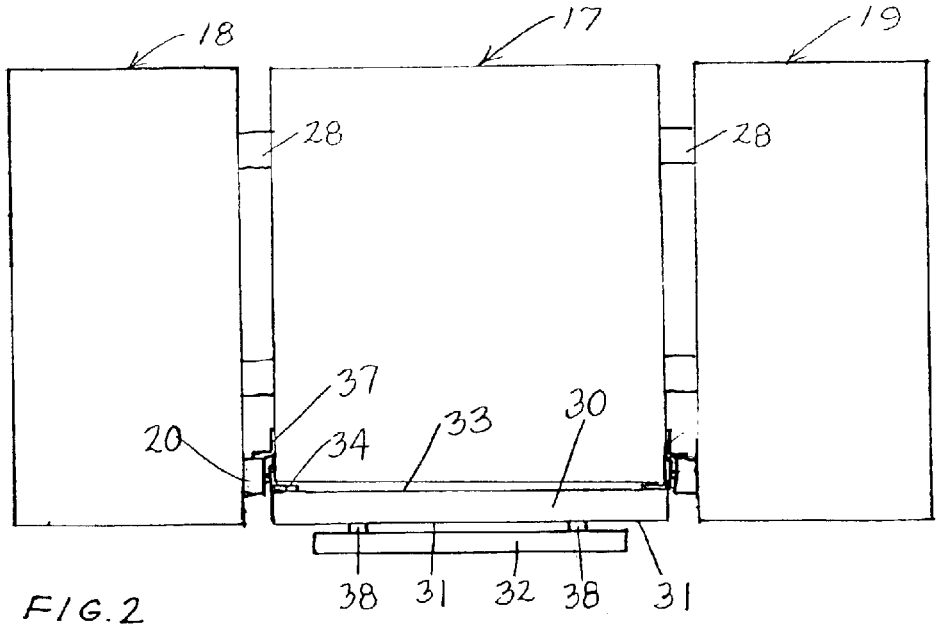
FIG. 2 is a plan view of the assembly of FIG. 1.

FIG. 2 is a top plan view of the assembly of FIG. 1, showing the top module 17, the lifting columns 20, the mounting panel 30 with the screen 32, and spacers 38 inserted between the panel 30 and the screen 32 to allow for ventilation and cooling of the electronics in the screen. Spacers 28 are provided between the base module and the end modules 18, 19 to accurately and securely position the various modules relative to each other, and may be fixed to the base module and/or top module and/or end modules by any type of connector commonly provided on furniture intended for assembly and disassembly in the home, e.g. quarter turn connectors. The positions of the connectors on the components are standardized so that the consumer may choose from a number of modules, as desired, available in the retail store. Each column 20 is secured to the base module 10 by means of an angle bracket 37, and the mounting panel 30 is secured to the columns 20 by means of vertically oriented angle brackets 34.

Figure 3:
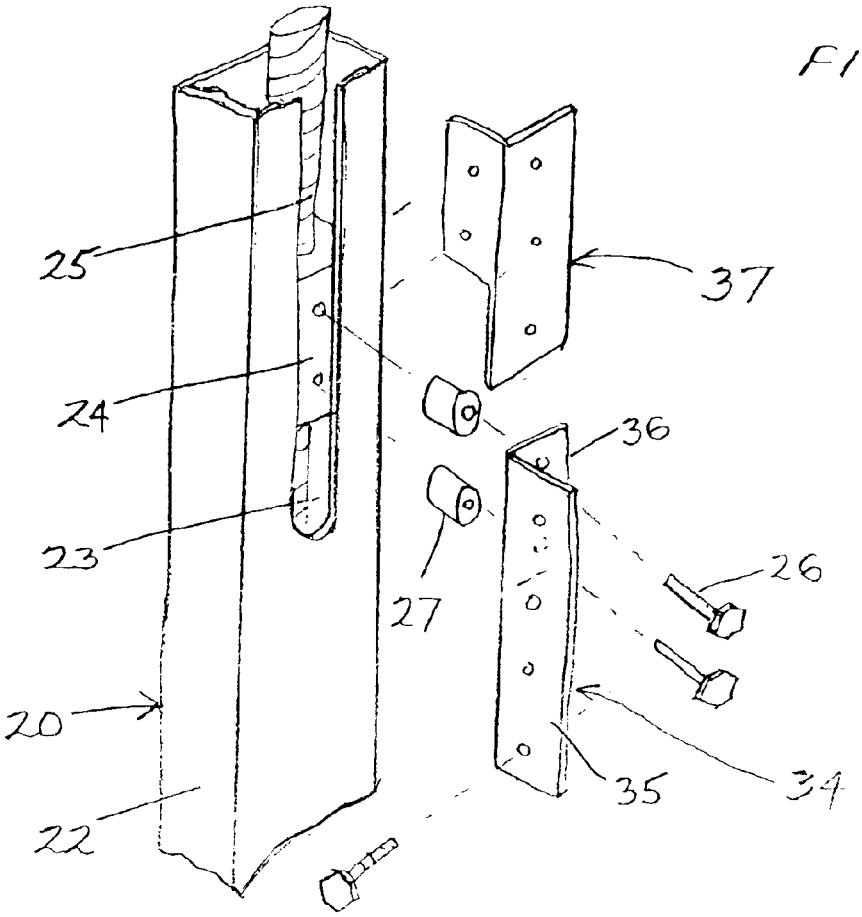
FIG. 3 is an exploded perspective of the bracket for the mounting panel and the lifting column.

FIG. 3 shows the column 20 and the brackets 34 and 37 in greater detail. The column 20 includes a tubular housing 22 having a substantially rectangular profile with a slot 23 in one wall where a vertically movable block 24 which can be accessed for securing the bracket 34. The bracket 34 is secured to the block 24 by means of bolts 26 received through holes in the outside leg 36 and threaded into nuts fixed in the block 24. Spacers in the form of spools 27 are received through the slots 23 between the bracket 34 and the block 24. The bracket 34 is fixed to the mounting panel by bolts or machine screws received through holes in the inside leg 35. The leg 35 is considerably longer than the leg 36, because it must be screwed to the wooden mounting panel 30. Likewise the bracket 37 has a longer leg for securing to the base than the leg which is secured to the lifting column 30.

The lifting columns 30 are manufactured by the German company K+B Ergonomietechnik and are commercially available from Gross Stabil Corporation in Coldwater, Mich. The Model TMi 240 lifting column can be provided with a height which is especially suitable for the furniture assembly of the present invention, in particular for raising and lowering the mounting panel carrying a screen. Briefly, the lifting columns operate by rotating a threaded shaft 25 mounted vertically in each tube 22, the blocks 24 having thread-engaging means which cause the blocks to move up and down synchronously as the shafts are rotated by electric motors.

Figure 4A:
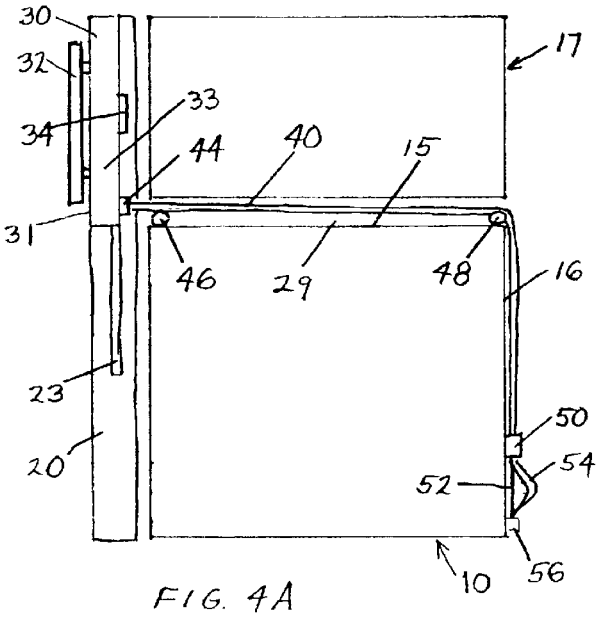
FIG. 4A is a side elevation view of the mounting panel (in the raised position), lifting column, base module, top module, and connecting harness.

FIG. 4A shows the mounting panel 30 in the raised position, the brackets 34 being fixed to the rear surface 33 of panel 30 and being moved by blocks 24 traveling within the lifting columns 20, as previously explained. A harness 40 of a plurality of wires 54 is secured to the rear surface 33 by a clamp 44 and is received through an aperture (not shown) in the panel 30. The exterior of harness 40 is a sheath, preferably a plastic sheath, and it preferably contains a sufficient number of wires to accommodate all signal sources that could possibly be used to feed signals to the screen 32. These wires are connected at one end to the signal sources (unused wires just hang loose) and at the other end these wires are connected to the screen 32 for providing signals and power to generate an image.

Figure 4B:
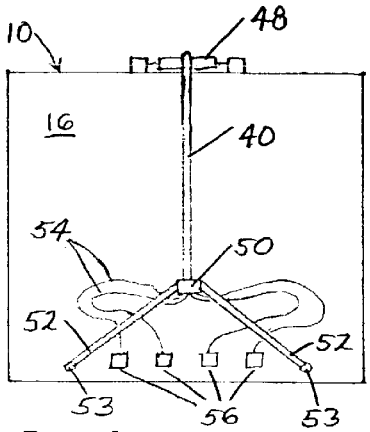
FIG. 4B is a rear elevation view of the base module and connecting harness when the mounting panel is in the position of FIG. 4A.

The electronics for image generation are provided in the screen assembly by the manufacturer of the screen assembly. The harness 40 is fed around and over a front roller 46 fixed to the top surface 15 of the base module 10, through the space 29 between the base module 10 and the top module 17, and over a rear roller 48. Each of the rollers 46, 48 is journaled between a pair of supports and turns freely. The harness 40 has a clamp 50 attached securely thereto. Clamp 50 is movable along with harness 40 with respect to the rear surface 16 of the base module 10. Referring also to FIG. 4B, this clamp 50 is loaded downward by a pair of elastic tethers 52 which are each fixed at one end to the clamp 50 and at the other end to an eye bolt 53 or the like to the bottom of the rear surface 16 of the base module 10. The tethers are under low tension in this view as the harness 40 is fully retracted across the rear surface 16 of the base module. Below the movable clamp 50, the exterior sheath is removed from the harness 40 to expose wires 54 which are connected to connector blocks 56 that serve as inputs from, e.g., a TV antenna, a cable box, a satellite box, a DVD, a VCR, and a PC. Since the harness 40 is fully retracted, the individual wires are free to curl as a result of slack below clamp 50. This is acceptable because at this position the wires are out of sight and cannot get caught between any moving parts. However, harness 40 remains taut above the clamp 50 so that it cannot become damaged during motion of the mounting panel.

Figure 5A:
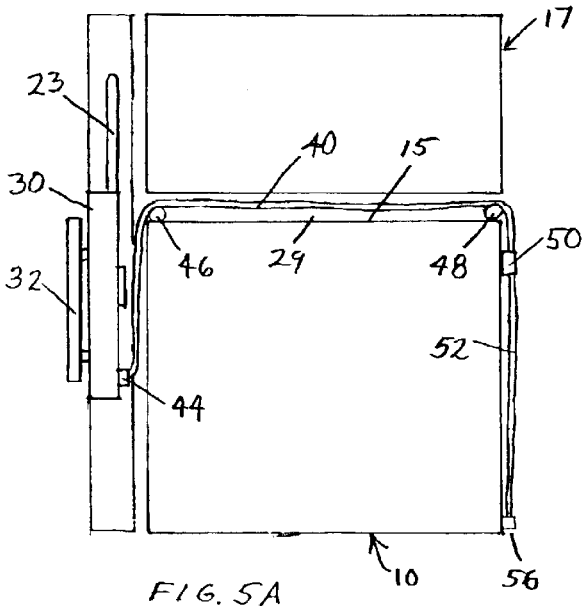
FIG. 5A is a side elevation view of the mounting panel (in the lowered position), lifting column, base module, top module, and connecting harness.
Figure 5B:
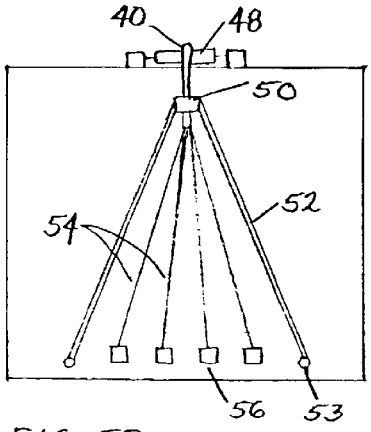
FIG. 5B is a rear elevation view of the base module and connecting harness when the mounting panel is in the position of FIG. 5A.

FIG. 5A shows the mounting panel 30 in the lower position. As the panel 30 is lowered to this position by the action of the lifting columns 30, the harness 40 is drawn over the rollers 46 and 48. Referring also to FIG. 5B, the elastic tethers 52 are stretched to keep the harness 40 under some tension, so that it remains in place on the rollers, which may be further assisted by profiling the rollers. The individual wires 54 straighten out to the position shown as the slack is reduced. However, they should not be under tension as this might stress the connections at connectors 56. Note that a retraction mechanism other than the elastic tethers may be used, e.g. a spring of a type having appropriate characteristics, or a weight fixed to the clamp 50.

It should also be noted that the space 29 between the base module 15 and the upper module 17 is not exposed, regardless of the position of the screen 32, insofar as this would be unsightly, and further would present the possibility of someone's fingers or hands being pinched in the rollers or caught between the mounting panel and the modules as it moves. However there are also safety features provided which will stop all motion in the event that resistance is encountered, as will be described below.

Figure 6A:
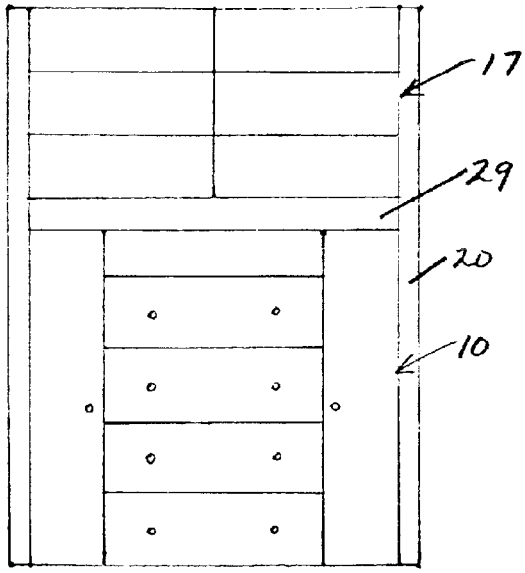
FIG. 6A is a front elevation of the first embodiment of a base module and an upper module, with the mounting panel removed.
Figure 6B:
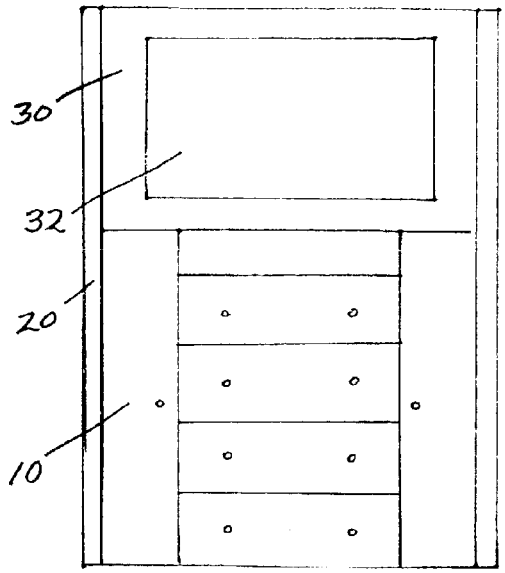
FIG. 6B is a front elevation of the first embodiment of a base module and an upper module, with the mounting panel in the raised position.
Figure 6C:
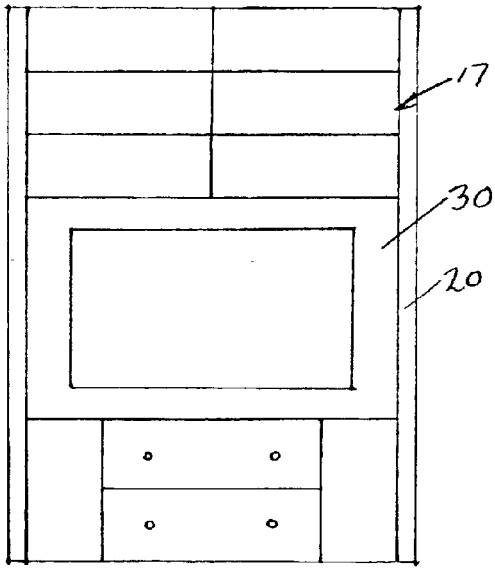
FIG. 6C is a front elevation of a first embodiment of a base module and an upper module, with the mounting panel in the lowered position.

FIG. 6A is a schematic elevation of the base module 10 and the top module 17 without the end modules, and without the mounting panel attached to the lifting columns 20. The top surface 15 of the base module and the bottom of the top module 17 form the space 29 containing rollers 46, 48, shown in FIGS. 4A and 5A. The top module 17 is shown having shelves, but may be constructed with cabinets or other features. The modules 10, 17 can be formed as a single unit, but forming them separately allows the consumer to select from a range of combinations. FIG. 6B shows the mounting panel 30 carrying the flat screen 32 in the raised position, where it covers the top module, and FIG. 6C shows the panel 30 in the lowered position, where the top module 17 is exposed for access.

Figure 7A:
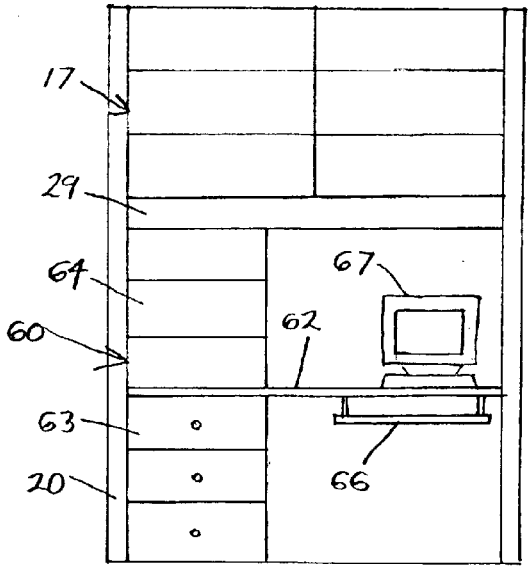
FIG. 7A is a front elevation of a second embodiment of a base module and an upper module, with the mounting panel removed.
Figure 7B:
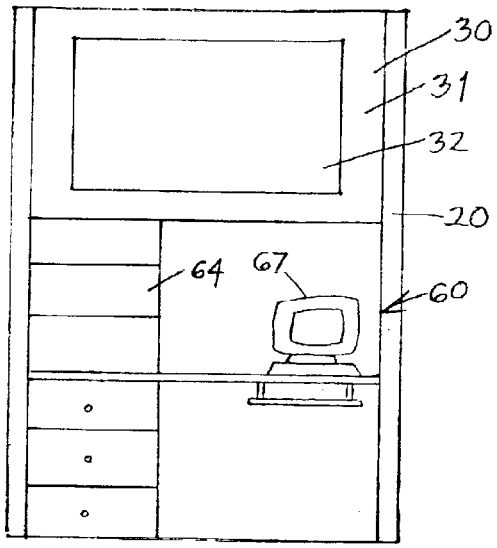
FIG. 7B is a front elevation of the second embodiment of a base module and an upper module, with the mounting panel in the raised position.
Figure 7C:
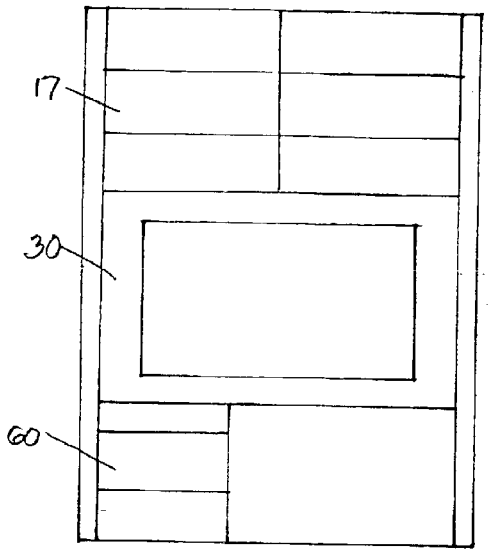
FIG. 7C is a front elevation of the second embodiment of a base module and an upper module, with the mounting panel in the lowered position.

FIG. 7A shows an alternative base module 60, designed as a computer work station, having a desk surface 62, with drawers 63 and leg space below, shelves 64 above, a retractable keyboard leaf 66, and a computer monitor 67. This base module 60 is the same height as the base module 10 of the first embodiment, and so can take the same top module 17 as shown. The end modules are not shown, but could be chosen as open shelves for peripherals such as a printer, scanner, disk storage, etc. FIG. 6B shows the panel 30 in the raised position, which allows access to the work station 60. FIG. 6C shows the panel 30 in the lower position, where the top module is exposed for access. The arrangement of FIGS. 7A–7C permits an apartment dweller having limited space to cover the computer work station and to have the screen 32 at a comfortable viewing height in a living room. Also, this arrangement affords the user with a greater degree of flexibility in that various activities, such as surfing the Internet, can be done from a couch, with an infrared keyboard and activating the flat screen 30 rather than being confined to using the monitor 67 and sitting at the desk. It is also possible to simultaneously utilize both the flat screen 30 and the monitor 37 for different purposes.

Figure 8:
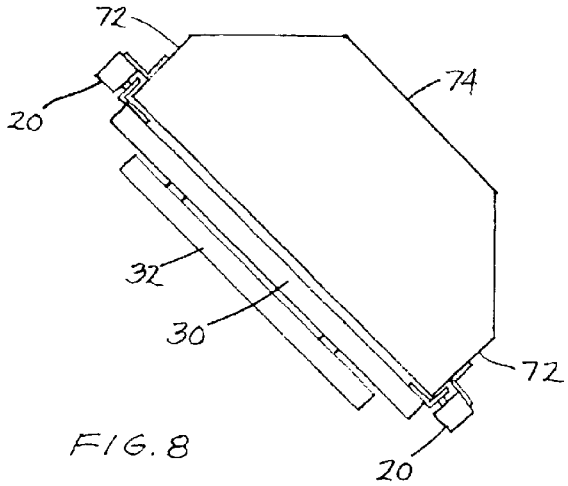
FIG. 8 is a plan view of a third embodiment of a modular furniture assembly according to the invention, as installed in a corner of a room.

FIG. 8 depicts an arrangement that makes it possible to mount a flat screen in a corner of the room. Such screens are commonly mounted on a wall. However, where wall space is at a premium, it has been difficult to accommodate the flat screens, particularly in view of their large size. Corner space is usually more readily available than wall space. However, it has heretofore not been possible to mount the flat screens in a corner since they require a flat mounting surface.

In accordance with the invention, a base module 70 is provided which is designed to fit in a corner of a room by being shaped substantially as a right triangle. The conventional shape of a piece of furniture designed to fit in a corner is modified to have truncated side corners 72 shaped and sized for accommodating the lifting columns 20 for attachment thereto. Also, the rear corner 74 is truncated to form a space in the corner of the room to enable mounting the tethers 52 and connectors 56, as shown in FIGS. 4B and 5B.

Figure 9:
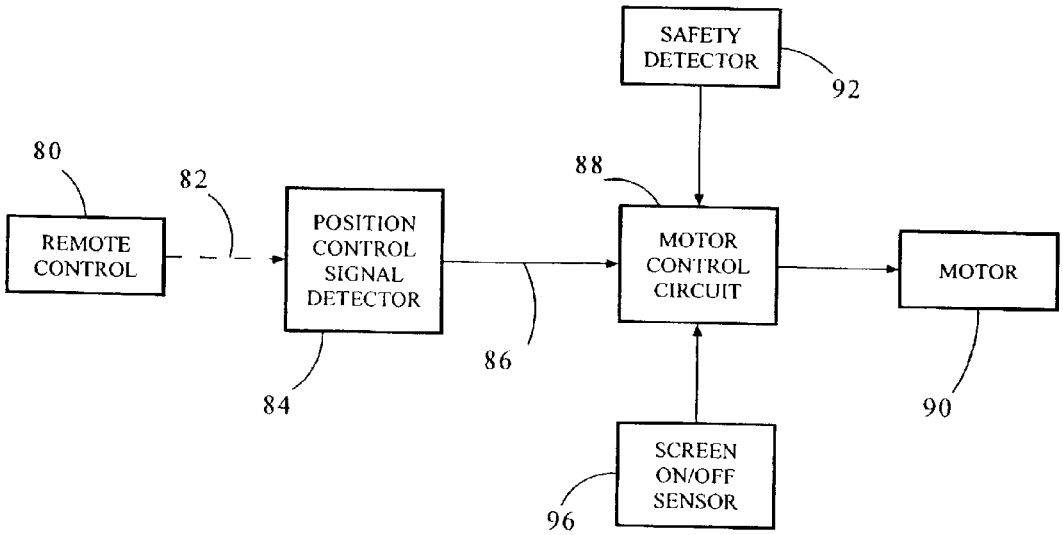
FIG. 9 is a schematic block diagram of a control circuit for vertically adjusting the position of the mounting panel.

FIG. 9 is a schematic block diagram of a control circuit used for adjusting the vertical position of the mounting panel. A dedicated remote control 80 of the conventional kind, but generating a signal different from that used to control the TV (e.g. volume, channels) emits a position control signal 82 when its buttons (not shown) are pressed by the user. Alternatively, the remote control for the mounting panel can be combined into a remote control for the TV in a manner that is readily apparent to anyone with ordinary skill in the art.

Position control signal detector 84 detects signal 82, processes it as explained below in connection with FIG. 10, and outputs control signal 86 to motor control circuit 88 which controls reversible motor 90. Motor 90 powers the lifting columns, as described above.

Safety detectors 92 are provided to detect when a person's hand, for example, is in a position which would result in injury if the mounting panel were to move in accordance with a command received from remote control 80. Preferably, detector 92 is a bar (not shown) that extends along the entire top of mounting panel 30. Another such bar can be installed along the bottom of the panel 30. The bar is mounted to the panel 30 with micro-switches that open when the bar is deflected from its normal position. Thus, if a person is standing with his hand on the top of the mounting panel, this would deflect the bar sufficiently to open a micro-switch and generate a motion inhibit signal 94 to the motor control circuit 88. Thus, motion of the mounting panel 30 is blocked until the inhibit signal is ended.

Sensor 96 is provided to detect when the screen 32 is turned OFF. When the OFF mode is detected, a home position control signal 98 is inputted to motor control circuit 88 which, in turn, positions the mounting panel 30 in its upper-most position. It is presumed that when the screen 32 is OFF, it is left unattended. By automatically raising the mounting panel 30, the invention provides a safeguard against someone inadvertently colliding with the screen in the dark or accidentally banging against it with something. It is also a safer position with children in the house.

Figure 10:
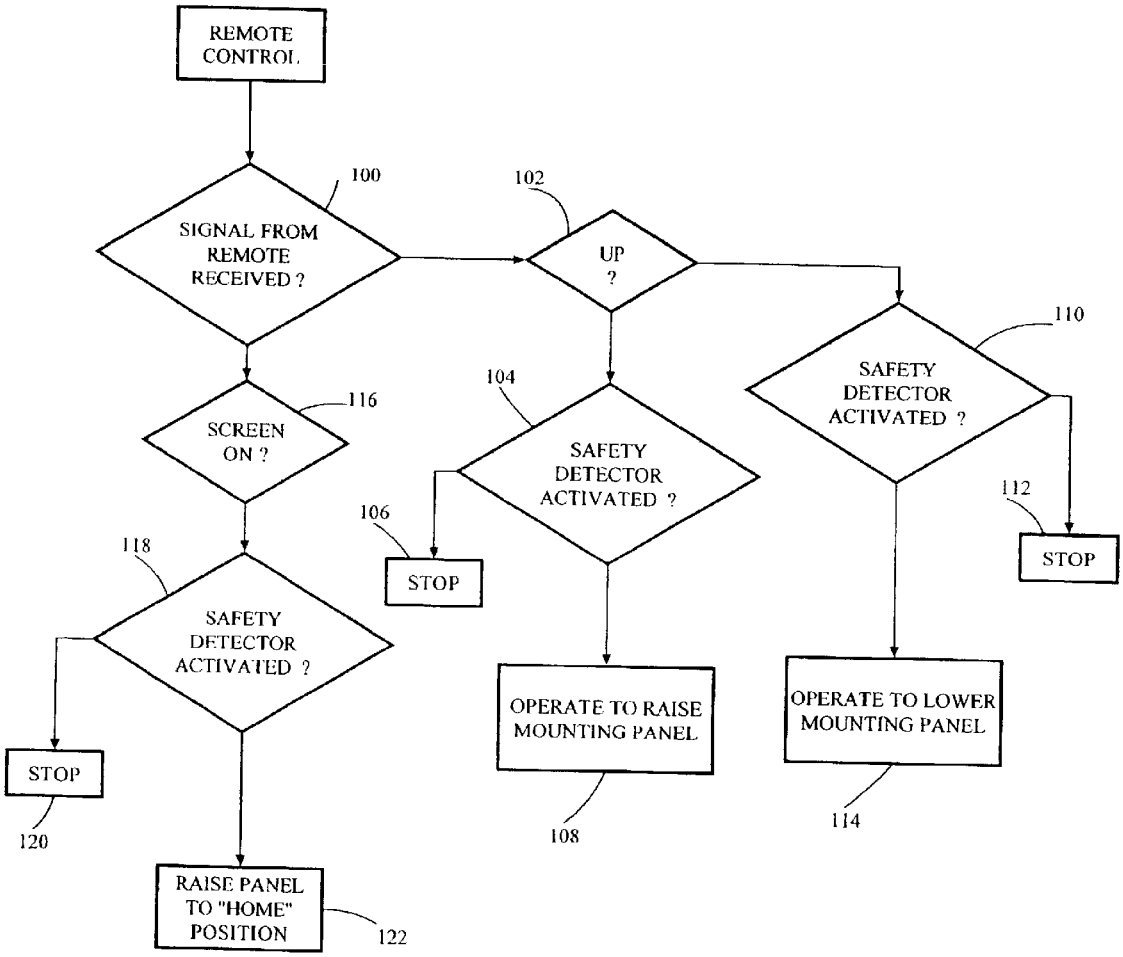
FIG. 10 is a flowchart of operations for controlling the vertical position of the mounting panel.

FIG. 10 depicts the operations carried out by the combination of position signal detector 84 and motor control circuit 88. Per operation 100, the system checks at preset intervals controlled by a high frequency clock whether a signal has been received from remote control 80. If such a signal has been received, step 102 determines whether it is an UP motion command. If it is, then step 104 checks whether the safety detector has been activated. If it has, then motion is inhibited, per 106. If the safety detector has not been activated, then step 108 raises the mounting panel 30 for as long as a signal is being received from the remote control.

If step 102 determines that the received signal is not an UP signal, it is presumed that the signal is a DOWN signal. Step 110 is similar to step 104 in checking whether the safety detector 92 is activated. If it is, then motion is inhibited by step 112. Otherwise, step 114 lowers the mounting panel 30 for as long as a signal is being received from the remote control.

If step 100 determines that no signal is being received from the remote control, step 116 checks whether the screen is ON. If it is, then the flow of steps returns to step 100. If the screen is OFF, step 118, which is similar to step 104, checks whether the safety detector 92 is activated. If it is, then motion is inhibited by step 120. Otherwise, the mounting panel is raised to a preset "home" position, per step 122, which typically would be the upper-most position reachable by the lifting mechanism.

Although a preferred embodiment of the present invention has been described in detail above, various modifications thereto will be readily apparent to anyone with ordinary skill in the art. For example, the lifting columns need not be located toward the front of the base, but may be located further back and out of sight, being connected to the mounting panel by larger brackets than those shown in the drawings. It is also possible for the lifting mechanisms to be pneumatically powered. All such modifications are intended to fall within the scope of the present invention.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A furniture assembly comprising:

a base having a front, a rear, and a pair of opposed sides;

a pair of lifting mechanisms arranged adjacent to respective said sides, each said lifting mechanism comprising means for vertically raising and lowering an article fixed thereto;

a mounting panel arranged adjacent to the front of said base and fixed to said lifting mechanisms so that said mounting panel can be vertically raised and lowered by said lifting mechanisms;

a flat electronic display screen fixed to said mounting panel; and at least one wire coupled to said display screen for inputting electronic video signals, wherein said base is configured as a base module, said assembly further comprising at least one end module which can be detachably fixed to a respective at least one of said sides of said base module with a respective at least one of said lifting mechanisms between said at least one end module and said base module.

2. A furniture assembly as in claim 1 wherein said mounting panel can be vertically raised and lowered between an upper position and a lower position, said mounting panel at least partially covering said base in said lower position.

3. A furniture assembly as in claim 2 further comprising a top section situated above said base, said mounting panel at least partially covering said top section in said upper position.

4. A furniture assembly as in claim 3 wherein said base is formed as a base module and said top section is formed as a top module which is detachably fixed to said base module.

5. A furniture assembly as in claim 1 wherein said base is formed as a base module, said assembly further comprising a top module which is detachably fixed to said base module above said base module.

6. A furniture assembly as in claim 1 wherein each said module comprises at least one of at least one drawer, at least one cabinet, and at least one shelf.

7. A furniture assembly as in claim 1 wherein said base comprises a computer work station.

8. A furniture assembly as in claim 1 wherein said base is profiled to fit in the corner of a room with one of said lifting columns adjacent to each of two walls of the room, whereby said mounting panel extends between said walls.

9. A furniture assembly as in claim 1 further comprising a space through which said at least one wire extends between the front and the rear of said base.

10. A furniture assembly as in claim 9 further comprising means for moving said at least one wire through said space so that said harness remains substantially taut between said rear of said base and said mounting panel as said mounting panel is raised and lowered.

11. A furniture assembly as claim 10 wherein said means for moving said at least one wire through said space comprises means for retracting said at least one wire so that any slack in said at least one wire accumulates at the rear of said base.

12. A furniture assembly as in claim 11 wherein said means for retracting said at least one wire comprises at least one elastic tether having one end fixed to said at least one wire and another end fixed to said base.

13. A furniture assembly as in claim 10 wherein said at least one wire moves from said rear to said front as said panel is lowered, and from said front to said rear as said panel is raised.

14. A furniture assembly as in claim 10 wherein said at least one wire comprises a plurality of wires connected to a plurality of connectors on the rear of said base, each said connector providing an electronic signal input from a different source of video signals.

15. A furniture assembly as in claim 1 wherein each said lifting mechanism comprises a lifting column located toward the front of said base, each said lifting column comprising a vertically movable block to which said mounting panel is fixed.

16. A furniture assembly as in claim 15 wherein each said lifting column comprises a housing, a motor driven threaded shaft in said housing, and a slot in said housing which parallels said shaft, each said block engaging said threaded shaft in said housing so that said blocks are raised and lowered synchronously as said shafts are driven to rotate.

17. An apparatus for positioning a flat electronic display screen, comprising:

a furniture piece having a front facing into a room, and a rear;

motive means for moving the flat electronic display screen vertically in a plane adjacent to the front of said furniture piece;

powered drive means for driving said motive means;

drive control means for actuating said powered drive means to move said flat electronic display screen to a desired position in said plane; and a sensor for detecting when said flat electronic display screen is turned OFF to generate an output signal;

wherein said drive control means responds to said output signal when said screen is turned OFF to move said screen to a predetermined position, and a safety detector including means for inhibiting motion of said screen in said plane when the detector is activated by a person touching a portion of said motive means.

18. An apparatus as in claim 17, wherein said predetermined position is an uppermost position in said plane.

19. A furniture assembly comprising:

a base having a front, a rear, and a pair of opposed sides;

a pair of lifting mechanisms arranged adjacent to respective said sides, each said lifting mechanism comprising means for vertically raising and lowering an article fixed thereto;

a mounting panel arranged adjacent to the front of said base and fixed to said lifting mechanisms so that said mounting panel can be vertically raised and lowered by said lifting mechanisms;

a flat electronic display screen fixed to said mounting panel;

at least one wire coupled to said display screen for inputting electronic video signals, a space through which said at least one wire extends between the front and the rear of said base, and means for moving said at least one wire through said space so that said harness remains substantially taut between said rear of said base and said mounting panel as said mounting panel is raised and lowered.

20. A furniture assembly as claim 19 wherein said means for moving said at least one wire through said space comprises means for retracting said at least one wire so that any slack in said at least one wire accumulates at the rear of said base.

21. A furniture assembly as in claim 20 wherein said means for retracting said at least one wire comprises at least one elastic tether having one end fixed to said at least one wire and another end fixed to said base.

22. A furniture assembly as in claim 19 wherein said at least one wire comprises a plurality of wires connected to a plurality of connectors on the rear of said base, each said connector providing an electronic signal input from a different source of video signals.

* * * * *